US009157053B1

(12) United States Patent
Tupaj

(10) Patent No.: US 9,157,053 B1
(45) Date of Patent: Oct. 13, 2015

(54) LAUNDRY WASHING MACHINE DEODORIZER

(76) Inventor: Thomas Tupaj, Fort Collins, CO (US)

( * ) Notice: Subject to any disclaimer, the term of this patent is extended or adjusted under 35 U.S.C. 154(b) by 257 days.

(21) Appl. No.: 12/803,569

(22) Filed: Jun. 30, 2010

Related U.S. Application Data

(60) Provisional application No. 61/269,924, filed on Jul. 1, 2009.

(51) Int. Cl.

| | |
|---|---|
| ***C11D 7/54*** | (2006.01) |
| ***C11D 7/04*** | (2006.01) |
| ***C11D 3/395*** | (2006.01) |
| ***C11D 3/39*** | (2006.01) |
| ***C11D 11/00*** | (2006.01) |

(52) U.S. Cl.
CPC ..... *C11D 3/391* (2013.01); *C11D 3/3951* (2013.01); *C11D 11/00* (2013.01)

(58) Field of Classification Search
None
See application file for complete search history.

(56) References Cited

U.S. PATENT DOCUMENTS

| | | | | |
|---|---|---|---|---|
| 4,272,386 | A | 6/1981 | Draper, Jr. et al. | |
| 4,526,698 | A * | 7/1985 | Kuroda et al. | 510/305 |
| 5,298,183 | A | 3/1994 | Connor et al. | |
| 5,330,769 | A | 7/1994 | McKinzie et al. | |
| 5,332,518 | A | 7/1994 | Kuroda et al. | |
| 5,665,427 | A | 9/1997 | Horne et al. | |
| 5,755,992 | A | 5/1998 | Jeffrey et al. | |
| 5,759,970 | A | 6/1998 | Prevost et al. | |
| 5,854,197 | A | 12/1998 | Duccini et al. | |
| 5,858,447 | A * | 1/1999 | Kuhn | 426/654 |
| 5,944,704 | A * | 8/1999 | Guarracino et al. | 604/359 |
| 6,022,843 | A | 2/2000 | Shanks et al. | |
| 6,025,312 | A | 2/2000 | Saito et al. | |
| 6,110,882 | A | 8/2000 | Evers | |
| 6,159,922 | A | 12/2000 | Williams | |
| 6,165,965 | A | 12/2000 | Schalitz et al. | |
| 6,326,340 | B1 | 12/2001 | Labib et al. | |
| 6,530,384 | B1 | 3/2003 | Meyers et al. | |
| 6,534,463 | B1 | 3/2003 | Briatore et al. | |
| 6,554,007 | B2 | 4/2003 | Wise | |
| 6,619,302 | B2 | 9/2003 | Labib et al. | |
| 6,762,160 | B2 | 7/2004 | Barbeau et al. | |
| 6,770,610 | B2 | 8/2004 | Takeuchi et al. | |

(Continued)

FOREIGN PATENT DOCUMENTS

| | | |
|---|---|---|
| CA | 2 361 741 C | 5/2003 |
| GB | 1 575 792 | 10/1980 |

(Continued)

OTHER PUBLICATIONS

Non-Toxic Home Cleaning http://eartheasy.com/live_nontoxic_solutions.htm, Accessed Feb. 8, 2012.*

(Continued)

*Primary Examiner* — David J Blanchard
*Assistant Examiner* — Sarah Chickos
(74) *Attorney, Agent, or Firm* — James K. Poole, Esq.

(57) ABSTRACT

A deodorizing composition and method of application thereof for removing and controlling odor-causing organisms that grow on the laundry product residues which deposit on the plumbing of some laundry washing machines. The composition comprises pH adjusting acids and other materials commonly used to retard food spoilage or act as a medical antiseptic, mixed with borax and/or other boron compounds. Sources of peroxides can also be included.

18 Claims, 4 Drawing Sheets

(56) References Cited

U.S. PATENT DOCUMENTS

| | | | | |
|---|---|---|---|---|
| 7,098,174 | B2 | 8/2006 | Takemura et al. | |
| 7,326,674 | B2 | 2/2008 | Sheirs et al. | |
| 7,354,888 | B2 | 4/2008 | Mostoller | |
| 7,358,219 | B2 * | 4/2008 | Yamaguchi et al. | 510/287 |
| 7,371,789 | B2 | 5/2008 | Sin | |
| 7,462,590 | B2 | 12/2008 | Tichy et al. | |
| 7,517,413 | B2 | 4/2009 | van Buskirk et al. | |
| 7,534,756 | B2 | 5/2009 | Tichy et al. | |
| 2001/0039166 | A1 * | 11/2001 | Tran et al. | 451/36 |
| 2002/0187119 | A1 * | 12/2002 | Greer et al. | 424/76.2 |
| 2005/0065054 | A1 | 3/2005 | Manske et al. | |
| 2005/0262644 | A1 | 12/2005 | Oak et al. | |
| 2007/0083998 | A1 * | 4/2007 | Leskowicz | 8/115.51 |
| 2007/0129279 | A1 | 6/2007 | Sheirs et al. | |
| 2008/0041117 | A1 | 2/2008 | Lee | |
| 2009/0032063 | A1 | 2/2009 | Haas et al. | |

FOREIGN PATENT DOCUMENTS

| | | |
|---|---|---|
| JP | 08-120299 | 5/1996 |
| JP | 09-031495 | 4/1997 |
| JP | 10-110192 | 4/1998 |
| JP | 11-029797 | 2/1999 |

OTHER PUBLICATIONS

Borax: It's for Everything and the Kitchen Sink! http://thegreenists.com/home-care/borax-its-for-everything-and-the-kitchen-sink/9414 Posted on Nov. 24, 2011 by Stefanie, Accessed Feb. 1, 2012.*

* cited by examiner

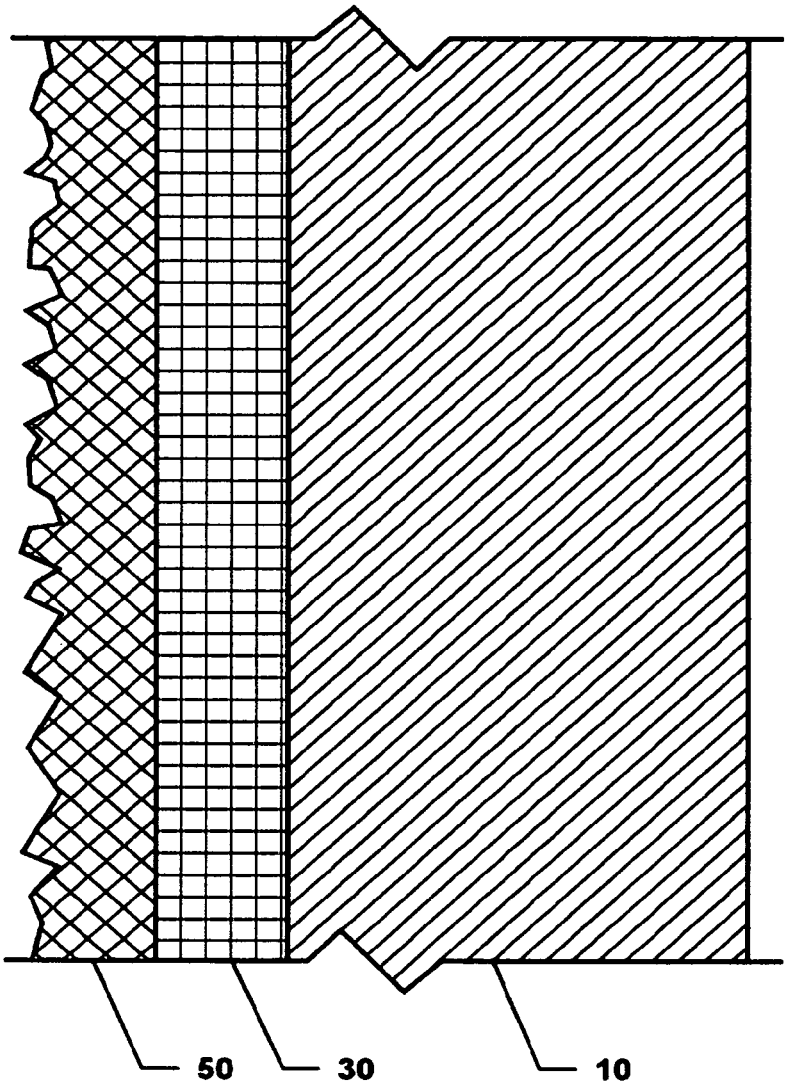
FIG. 1
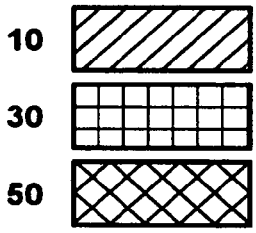

LAUNDRY WASHING MACHINE DEODORIZER

REFERENCE TO RELATED APPLICATIONS

This application claims priority from Applicant's Provisional Application U.S. Ser. No. 61/269,924, filed on Jul. 1, 2009.

BACKGROUND

1. Field of the Invention

This invention pertains to compositions and methods for deodorizing laundry washing machines.

2. Discussion of Relevant Art

Problem Definition

Certain laundry washing machine applications have a problem with odor-causing growths in the machine and on the laundry washed therein.

That the problem exists and is widespread is confirmed by the number of cleaning agents and washing machine designs available to address this specific issue. Certain of these machines require the use of special non-sudsing detergent formulas for cleaning and softening laundry. These may have the designation HE (for "high efficiency") on the label to indicate the special formula. Products are available to address the odor problem but they utilize chemicals and methods and they are not as effective as the composition disclosed in this application.

A number of class action lawsuits have been filed regarding these odor problems. Brief summaries of three of these suits follow.

Whirlpool: In April 2009, a group of seventeen consumers who purchased Whirlpool Duet, Whirlpool Duet Sport, or Whirlpool Duet HT front-loading automatic washers filed an amended master class action complaint against Whirlpool Corporation. The lawsuit, entitled *In re: Whirlpool Corp. Front-Loading Washer Products Liability Litigation* (MDL No. 2001, U.S. District Court for Northern District of Ohio), charges that these front loading washers are defectively designed, and that the design defects create foul moldy and mildew odors that permeate the washing machines and consumers' homes.

LG: On May 6, 2008, Chimicles & Tikellis LLP and co-counsel filed a consolidated class action complaint in the District Court for the District of New Jersey against LG Electronics USA, Inc. ("LG") on behalf of consumers who purchased allegedly defective front load washing machines manufactured or sold by LG (the "Washing Machines"). The suit is entitled *Harper v. LG Electronics USA, Inc.,* 595 F. Supp2d 486 (D.N.J., Feb. 3, 2009).

According to the complaint, the washing machines suffer from design and/or manufacturing defects that lead to the formation of mold and mildew on the inside of the washing machines. In addition to being unsightly and smelly, the mold and mildew that forms on the interior of the washing machines can damage clothes and other items, substantially decrease the value of these high-end products, and produce foul and noxious odors, according to the complaint. The complaint alleges that the named plaintiffs have run bleach and other cleaning products through their washing machines in attempts to cleanse them of mold and mildew, but that these efforts have been unsuccessful.

Maytag: This lawsuit alleges that owners of Maytag Neptune Front-Load Washing Machines have claims concerning the door latch, wash motor, motor control and related circuit board failures, causing the machines to function improperly and users to experience odor, mold and mildew. Maytag has responded that its product is not defective, denies that it did anything wrong, and contends that it attempted to fix or repair all concerns raised by its customers. The Court is the Circuit Court for the State of Illinois, 20th Judicial Circuit, St. Clair County, Ill. The lawsuit is *Mink v. Maytag Corporation*, Civil Action No. 03L47.

These lawsuits indicate persistent odor problems with machines from several manufacturers, which are apparently unable to resolve the problems.

Shock Treatments:

Removal of the soap/detergent buildup is the primary operating mode of existing methods of laundry machine odor control products. With such products, the deposits are removed in a separate wash with oxidizers and caustic or acidic materials on a periodic shock treatment cycle. The drawback of such methods is that some of the residue deposit and some of the biofilm always remain on the internal plumbing because of the wetting characteristics of the laundry cleaning products. The residue that remains provides a basis for rapid recontamination of the new laundry materials that are deposited in subsequent cleaning cycles. Removal of the soap/detergent buildup is the primary operating mode of some of the existing methods of laundry machine odor control products. A non-exhaustive list of the product names and companies of manufacture could include:

AFFRESH® Washing Machine Cleaner from Whirlpool
TIDE® Washing Machine Cleaner from P&G
PUREWASHER® from Smellywasher.com
CLOROX® Washing Machine Cleaner from The Clorox Company Generic terminology for these products is difficult to obtain, since many ingredients are proprietary or disclosed only incompletely. To the best of Applicant's knowledge, the ingredients of these products include the following:

Affresh®:

Tide®: Sodium sulfate (processing aid), sodium carbonate (to remove water hardness), sodium percarbonate (oxygen bleach), nonanoyloxybenzenesulfonate (bleach activator), sodium aluminosilicate (to remove water hardness), sodium linear alkylbenzenesulfonate [??] (cleaning agent), sodium alkyl sulfonate (surfactant), fragrance, fatty alcohols (cleaning agent), sodium poly acrylate (dispersant), "silicone" [correct ID?] (suds suppressor, polyethylene glycol 4000 stabilizer), FD&C Blue 1 (colorant) and modified starch (fragrance carrier).

Purewasher®: Formula stated to be "proprietary and harmless," so the MSDS does not identify components. The company website indicates that the product is primarily a citrus product, probably including citric acid and/or [?] d-limonene Clorox®:

Such products attempt to remove the residue and biofilm in a separate wash with oxidizers and caustic or acidic materials on a periodic shock treatment cycle. The drawback of such methods is that some of the residue deposit and some of the biofilm always remain on the internal plumbing because of the wetting characteristics of the laundry cleaning products. The residue that remains provides a basis for rapid recontamination of the new laundry materials that are deposited in subsequent cleaning cycles.

Continuous Control Applications:

Two new applications utilize mechanisms involving entraining toxic materials into the surface to passivate it and suppress growth. Samsung is using colloidal particles of silver bonded to the internal surface of the tub, Silver Wash—

Silver Nano Health System™ as described in U. S. Published Patent Application No. 2008/0041117 of SAMSUNG ELECTRONICS CO., LTD. and in U.S. Pat. No. 7,371,789 of LG Electronics Inc. A deodorizing washing machine is disclosed in U. S. Published Patent Application No. 2005/0262644.

Amana is using Microban®, (MSDS: Microban Plastic Additive "B"), a proprietary material. Their U.S. Pat. No. 5,180,585 discloses antimicrobial compositions comprising tens of microns to submicron inorganic size core particles selected form the group consisting of the oxides of titanium, aluminum, zinc and copper, sulfates of calcium, strontium and barium; zinc and copper sulfides, zeolites, mica, talc, kaolin, mullite and silica, these core particles having a primary surface coating, comprising 0.05 to 20% by weight based on the core particles, of a metal or metal compound having antimicrobial properties selected from the group consisting of silver, silver oxide, silver halides, copper, copper (I) and (II) oxides, copper sulfide; zinc oxide, sulfide and silicates and mixtures thereof, which are coated with a secondary protective layer comprising 0.5 to 20 percent by weight and selected from the group consisting of silica, silicates, borosilicates, aluminosilicates, alumina, aluminum phosphate and mixtures thereof. These compositions can be suspended in 2-propanol (5-10 percent by volume) and entrained in the surface of the pliable machine door gasket to suppress mold growth, These treatments offer limited applicability in that only certain parts of certain machines are protected, while the compositions disclosed below can be applied to any surface which could become contaminated.

Additional features and advantages of the disclosed embodiments are described in, and will be apparent from, the following detailed description of preferred embodiments together with the drawings and the appended claims. The invention is further illustrated by the following drawings, in which like features are identified in the various figures by the same numerals.

BRIEF DESCRIPTION OF DRAWING

FIG. 1 is a sectional schematic diagram of a plumbing surface that is coated by detergent residue and various biological growths which produce odors during the wash cycle.

SUMMARY

Figure 2:
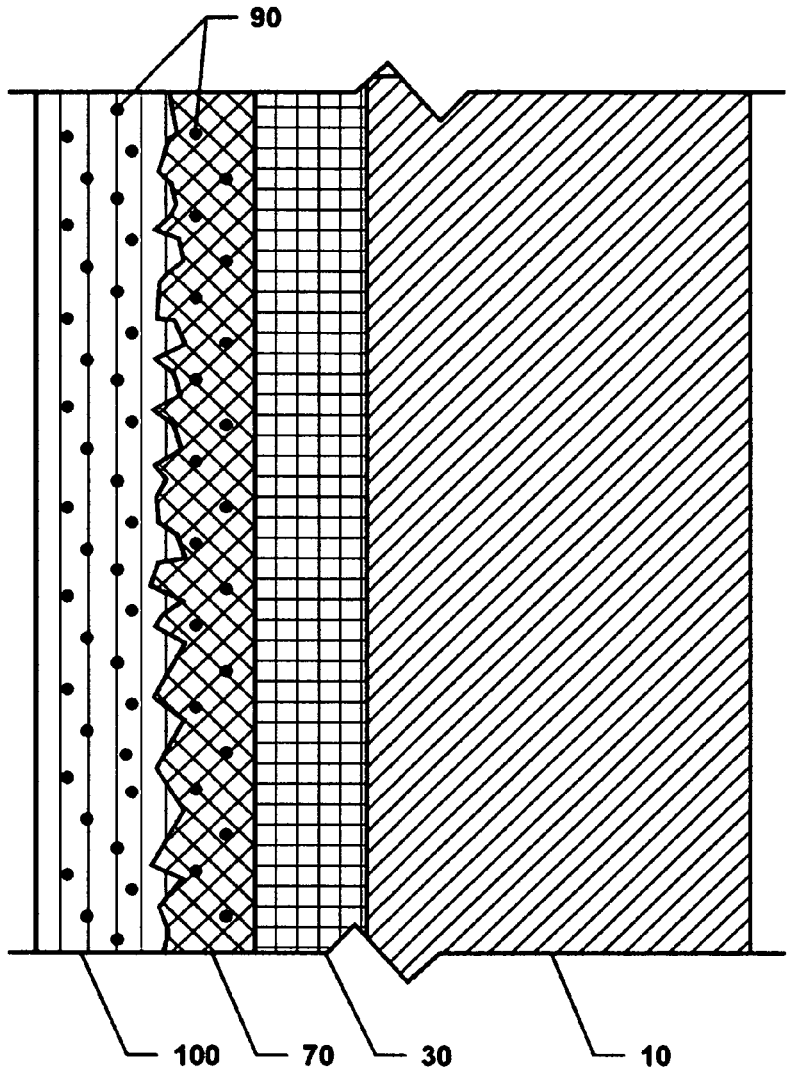
FIG. 2 is a sectional schematic diagram showing a high concentration of a deodorizing product in solution, which is disinfecting and diffusing into the biofilm and the existing detergent residue in the first stage of the disinfecting process during the first one to three minutes of the wash cycle when the product has dissolved.
Figure 2:
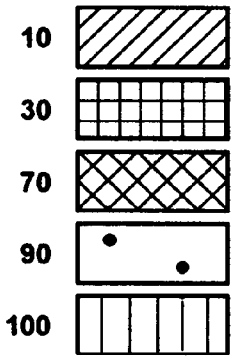

Deodorizing compositions are provided which can comprise effective amounts of ingredients including at least one boron compound, a bioactive salt and a weak organic acid. The boron compounds can be selected from boraxes, boric acids and alkali metal perborates. The bioactive salts are selected from those alkali metal salts of organic acids which are toxic to microorganisms but safe for humans, as discussed below. The weak organic acids can have from one to about three carboxyl groups, and dissociation constants producing pKa values from about 2 to about 22. Suitable examples include sorbic acid, citric acid, benzoic acid, propanoic acid and acetic acid. The bioactive salts and weak organic acids are preferably "generally recognized as safe" by the Food and Drug Administration (FDA).

Additional ingredients can include alkali metal salts of the organic acid(s) and/or alkali metal nitrates, nitrites or sulfites. Colored inorganic crystalline materials such as Epsom salts, can be added.

Also, inorganic peroxide sources such as alkali metal or alkaline earth metal percarbonates, perborates or persulfates, or carbamide peroxide, can be added.

The basic compositions can have ingredients present in the following proportions in weight percent:

boron compound(s)—about 80 to about 95
bioactive salt—about 0.5 to about 5
weak organic acid—about 0.5 to about 5.

Preferably, these proportions are:

boron compound(s)—about 90 to 95
bioactive salt—about 0.5 to about 2
weak organic acid—about 2 to about 5.

In compositions comprising peroxide sources, the proportions in weight percent are:

boron compound(s)—about 80 to about 95
bioactive salt—about 0.5 to about 5
weak organic acid—about 1 to about 5
inorganic peroxide source—about 2 to about 10

Preferably, these proportions are:

boron compound(s)—about 90 to about 95
bioactive salt—about 0.5 to about 2
weak organic acid—about 1 to about 3
inorganic peroxide source—about 3 to about 5.

The compositions are preferably prepared by methods of mixing the materials of a given formulation comprising peroxide sources to obtain a product with predetermined crystal shapes and sizes by steps of:

a) mixing about one fourth of the borax present with all of the peroxide source material in a manner effective to coat the crystals of the peroxide source with the borax, then b) adding the remaining ingredients, including all borax, and admixing the combined ingredients in a manner effective to thoroughly mix all ingredients without fracturing the larger crystals of the added ingredients.

The compositions, with or without peroxide sources, are employed to treat laundry washing machines by introducing effective amounts of same into the washing machine in a manner which enables the composition to dissolve substantially completely before the laundry cleaning materials dissolve during a normal wash cycle.

The present application identifies that certain HE class cleaning materials will wet-out or deposit on the surfaces of laundry machine plumbing, especially in HE machines, during the early stages of the wash cycle due to the low amounts of water used and the enhanced wetting characteristics of the materials used in the various HE cleaning products.

The present application identifies that some of this film remains after the rinse cycle because of the viscosity and wetting characteristics of these cleaning formulas. Subsequent cycles of detergent or softener use will continue to add to the film. The present application also identifies that the thin film that deposits (Hereinafter known as "Residue") and remains on the internal plumbing system surfaces contains soap, detergent, softener, fibers of cotton and wool, and other biological material that provides a medium for the growth of mold, mildew, bacteria, fungi and other flora or fauna (hereinafter know as "Biofilm") that create the odor problem.

The embodiments of a deodorizing composition and methods of application thereof can result in the control of odor-causing organisms which grow on the soap/detergent residue which is deposited at the plumbing/water interface of certain types of laundry washing machines and other apparatus. These organisms form what is known as a biofilm, and are random mixtures of the molds, mildews, fungi and bacteria that are prevalent in the local geographic areas of use and are capable of digesting organic materials found in the residue. An embodiment of the composition can comprise bioactive salts and weak acids plus borax, and is intended for use in conjunction with any commercially available laundry cleaning formula. In certain embodiments, the composition can comprise about one to ten weight percent sodium borate pentahydrate, about 70 to 99 weight percent of sodium borate decahydrate, about one to ten weight percent of boric acid, about one to ten weight percent of citric acid, about 0.5 to ten weight percent of benzoic acid, about 0.5 to ten weight percent of sorbic acid, plus about one to ten weight percent (collectively) of other borate salts and other similar salt-based materials approved by the food and Drug Administration (FDA) (i.e., "generally recognized as safe," or "GRAS") to suppress food spoilage.

Such materials are preferred because they are proven toxic to the organisms involved, yet are approved by the FDA to be commonly consumed by or used by persons with no ill effects. This list may change over time. The criteria to be included on the list are as follows. Under sections 201(s) and 409 of the Federal Food, Drug, and Cosmetic Act (21 CFR Part 184), any substance that is intentionally added to food is a food additive that is subject to premarket review and approval by FDA, unless the substance is generally recognized, among qualified experts, as having been adequately shown to be safe under the conditions of its intended use, or unless the use of the substance is otherwise excluded from the definition of a food additive. See the current GRAS Substances (SCOGS) Database for specific substances.

The composition is preferably introduced so as to employ a very small quantity of these biotoxic materials to create locally high concentrations of the composition and active ingredients in the residue film. By the end of a typical wash cycle, the small amount of the composition dispensed will have minimal effects on the environment through the used water discharged.

While not wishing to be bound by theory, it is believed that the present methods of applying these compositions provide two mechanisms to control biological growths, no matter what laundry products are used or the types and varieties of growths involved. It is believed that, at the start of the wash cycle, diffusion of boron-containing materials and other bioactive active ingredients will create a toxic environment in the biofilm growing on the existing Residue surface. This provides a mechanism for attacking existing growths in machines which are currently contaminated and emit objectionable odors. Furthermore, the co-deposition of a matrix of the composition in conjunction with commercial laundry cleaning formulas results a locally toxic surface that will be resistant to further growth of organisms. Subsequent new layers of soap/detergent residues will also form co-deposited films which suppress organism growth. Thus, this mechanism provides continuous control of organisms, film growth and odors by renewing the biotoxic nature of the film on a regular basis.

It is believed that the application of the composition so that it dissolves before the detergent or other cleaning agent results in a temporary low pH (acidic) condition at the residue surface, thereby activating other ingredients of the composition and/or increasing their effectiveness. This acid-activated composition, in solution, will be captured and contained in the residue matrix. Later, as the rest of the detergent dissolves and the cleaning cycle continues normally, a high pH wash solution is produced. The application of these compositions results in the suppression and control of biological growths which produce odors, stains and other undesirable effects. Based upon comparative tests, it has been observed that the application of various embodiments of the compositions increases the effectiveness of laundry machine odor control, compared with previously known "shock" technologies, methods and chemicals. The periodic use of such shock treatments is believed to allow recontamination of the machine during the weeks between shock treatments. The application of the various embodiments of these compositions therefore provides significant improvements over the "shock control" category of previous methods.

DETAILED DESCRIPTION OF PREFERRED EMBODIMENTS

It should be understood that the following description of preferred embodiments is merely representative of the many possible embodiments and thus is not intended to limit the scope of the claimed embodiments. Unless otherwise noted, all percentages are by weight. The term "and/or" is used in the conventional sense, in which "A and/or B" signifies that A, B or both can be present.

The compositions disclosed herein are mixtures of granular and powder forms of chemicals (hereinafter known as "Composition") comprising at least one boron compound such as sodium borate pentahydrate, sodium borate decahydrate or boric acid, and a weak organic acid such as citric acid, benzoic acid or sorbic acid. Other borate salts and any other forms of salt based materials approved by the FDA and listed as GRAS to suppress food spoilage can be included. These and similar materials are chosen for use because they are proven toxic to the target organisms involved ("biotoxic") yet are approved by the FDA and are commonly consumed by or used by people with no ill effects.

The method of application involves using the composition in conjunction with any detergent, soap or cleaner currently used by the public in HE washing machines. The method involves the placement of the composition in the drum of the machine or on top of the laundry cleaning materials in the dispenser drawer so that the composition dissolves before the laundry cleaning material(s) during the initial cycle of the washing process While not wishing to be bound by theory, this method appears to be effective in cleaning and sanitizing the residue surface because the composition contains materials that have proven to be toxic to organic growths at the locally high concentrations created at the surface of the residue. After the residue becomes locally toxic at the surface, the effect is to immediately reduce the amount of odor-causing growth in the machine. Weak organic acids are used to adjust the pH to the correct level to enhance the sanitizing effects of the other bioactive materials in the composition after they go into solution. Generally, it is appropriate to lower the local pH to a range of about 5 to 6.

It is believed that two modes of odor control are provided by the composition and method of application. First, it appears that the relatively high concentration of composition materials in the wash solution drives a portion of the chemicals by diffusion into the top surface of the existing biologic growth layer or residue, thereby attacking the organisms growing thereon. This mechanism is effective in contaminated washing machines by penetrating the biofilm and disinfecting existing organisms. (See Fick's First Law of Diffusion and the Concentration Gradient Model of Diffusion, Perry and Chilton's *Chemical Engineering Handbook*, published by McGraw Hill.)

Three prior methods known to Applicant attempt to remove the residue. AFFRESH®, disclosed in U.S. Pat. No. 6,451,746, is owned by Chemlink Laboratories. The other two products (TIDE® and PUREWASHER®) are apparently unpatented.

Removing the residue is extremely difficult to do because of the surface tension-related wetting characteristics of the residue material and the hydrophobic characteristics of the biofilm. Second, the method of operation recognizes that soap/detergent film deposition in washing machines is inevitable and therefore acts to suppress the ability of a biofilm to survive on any surface that forms by co-depositing toxic materials with the residue film. This method of operation can be utilized for continuous odor control. Prior "shock treatment" methods and chemicals such as AFFRESH®, TIDE® and PUREWASHER® do not provide effective continuous control.

The method of application results in the fast dissolving salts and acids of the Composition going into solution in the laundry solution before the slower dissolving detergents. Subsequently, the composition-laden water will dissolve the detergent and be entrained in the high viscosity fluid residue during the first minutes of the wash cycle. The method of operation utilizes the tendency of the high viscosity soap/detergent to be deposited on the washing machine's plumbing rather than by attempting to remove it as with prior art "shock treatments," as indicated by the types of materials found in Affresh®, Tide® and Pure Washer®. As the soap/detergent film matrix is built up, the regular use of the composition results in the bioactive materials being entrained in the matrix, which will continue to suppress the growth of biofilm.

At the beginning of the wash cycle there will be a small amount of water dissolving most of the composition before the soap/detergent is dissolved. This results in a relatively high concentration of the composition ingredients with relatively low pH (preferably about 5 to 6) at the surface of the residue that will subsequently diffuse into the top layer of the biofilm/residue during the first few minutes of the wash cycle. The various odoriferous biological growths on the surface will be attacked by the appropriate chemical(s) in the composition. Some of the chemical ingredients are more effective than others, depending upon the situation and specific types of growth(s) involved. Once again, the ability to address a wide range of biological growth is a significant improvement over known methods.

The transition between relatively low pH and higher pH is a significant function of the present composition and method. The biologically active food preservatives require an acidic environment to be most effective at suppressing growth. So, by design, the materials that are trapped in the residue matrix have the correct pH environment to perform their preservative functions. The boron that is contained in the borax and boric acid provides low toxicity ionic species to also sterilize the residue. The boron will also be trapped in the matrix to suppress future growth.

The inorganic peroxide source such as sodium percarbonate or sodium perborate will generate hydrogen peroxide when dissolved in the wash water. The peroxide and the acids will attack living organisms that are currently in suspension in water that was retained in the machine from previous runs. They will also attack organisms that will easily slough off residue surfaces with the turbulence of the wash cycle. These organisms could be deposited on the first load of laundry of the week, with undesirable consequences. This is a significant contribution to successful odor control in machines with a duty cycle of less than three loads a week.

Concurrent with the high concentration diffusion process given above, but lagging it by a few minutes, is the deposition process. During the early stages of the wash cycle, the high concentration composition solution will dissolve the high viscosity soap/detergent material. The high viscosity residue will subsequently deposit on the plumbing along with salts and acidic chemicals from the composition. This new layer will cover the previous top layer of residue and trap some of the materials of the composition in the deposit. The same sanitizing processes as given above will provide continued control of the biofilm. Experience thus far indicates that the mass of the composition dispensed in routine laundry use does not have a negative impact on septic systems. Finally, as the wash cycle continues, the full amounts of water and soap/detergents introduced into the machine and the pH will swing back up to the regular operating range (about 8 to 9) due to the buffering action built into the laundry products. The laundry cycle continues normally. However, the residue on the plumbing will continue to contain the toxic salts and acids so long as it coats the plumbing. These will diffuse though the residue over time to create a more even loading of the chemicals in the film. The effectiveness of the chemicals does not decrease due to drying of the film.

DISCUSSION OF FIGURES

Certain aspects of the environment in laundry washing machines and the effectiveness of the above compositions and methods are illustrated by the figures. All figures are a single sectional schematic view showing the progression of the phases of the specified application procedure.

FIG. 1 is a schematic diagram of a plumbing surface #10 that is coated by detergent residue #30 which subsequently provides a growth medium for various forms of biological growth #50 that produce the objectionable odors. The biological growth #50 is also known generically as a "biofilm" because the types of flora and fauna present are the result of the local environment. The biofilm #50 is responsible for the odor that can come from the laundry washing machine.

FIG. 1 is representative of the inner surface #10 of any piping, valves, drum or pump cavity in the laundry washing machine. FIG. 1 represents the starting condition of any experiment performed with various formulas of the composition. The inner surface #10 of any plumbing related part is coated with a residue #30 of detergent which subsequently provides a growth medium for biological growth #50. Whether the piping, valves, drum or pump cavity are involved, the odor problem is apparently due to the biofilm #50 consuming the residue #30 on a plumbing surface #10. The residue #30 is a matrix of soap, detergent, cotton or wool fibers, and any other organic matter that was introduced by the dirty laundry.

FIG. 2 is a schematic diagram showing a high concentration of the disinfecting composition 90 in solution #100, which is diffusing into the biofilm #70 in the first stage of the disinfecting process. This occurs during the first one to three minutes of the wash cycle, when the composition has dissolved but the high viscosity detergent has not. The plumbing surface #10 and original residue layer #30 remain unchanged.

This step in the disinfecting process utilizes the well known concept of diffusion to pressure the toxic molecules into the biofilm #70 by means of a concentration gradient. The density of the toxic molecules in the wash water #100 is much, much greater that the density of the toxic molecules in the biofilm #70. This creates an osmotic driving force to quickly propel the toxic molecules into the biofilm #70. The process requires rapid diffusion due to the short period of time allowed and the large concentration gradient provides that pressure. The plumbing surface #10 and original residue layer #30 remain unchanged.

Figure 3:
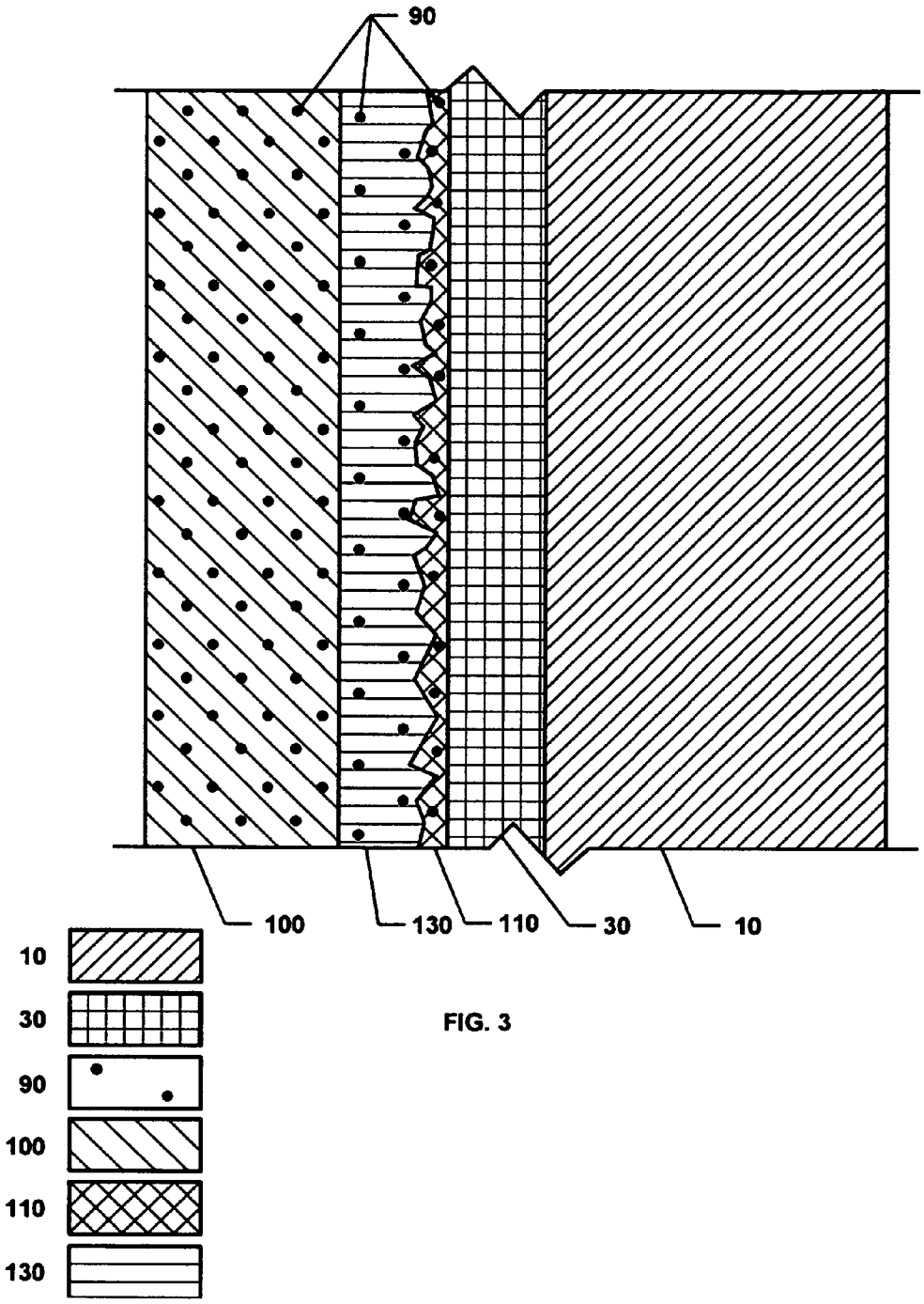
FIG. 3 is a sectional schematic diagram showing the deposition of a subsequent layer of detergent residue with the product entrained therein, creating a toxic surface which will suppress future growth in the initial two to eight minutes of the wash cycle.

FIG. 3 is a schematic diagram showing the deposition of a subsequent layer of detergent residue 130 with the composition 90 entrained therein, creating a toxic surface which will suppress future growth in the next few minutes of the wash cycle. The original mass of biofilm #70 from FIG. 2 has been reduced to the lesser mass of biofilm #110, which was the desired effect of the previous step. A new layer of detergent residue #130 is once again deposited on the remains of the previous biofilm #110. The presence of the composition 90 entrained in the new residue #130 is the result of the high concentration of the composition 90 in the water #100 from FIG. 2. Once again plumbing surface #10 and original residue layer #30 remain unchanged.

Figure 4:
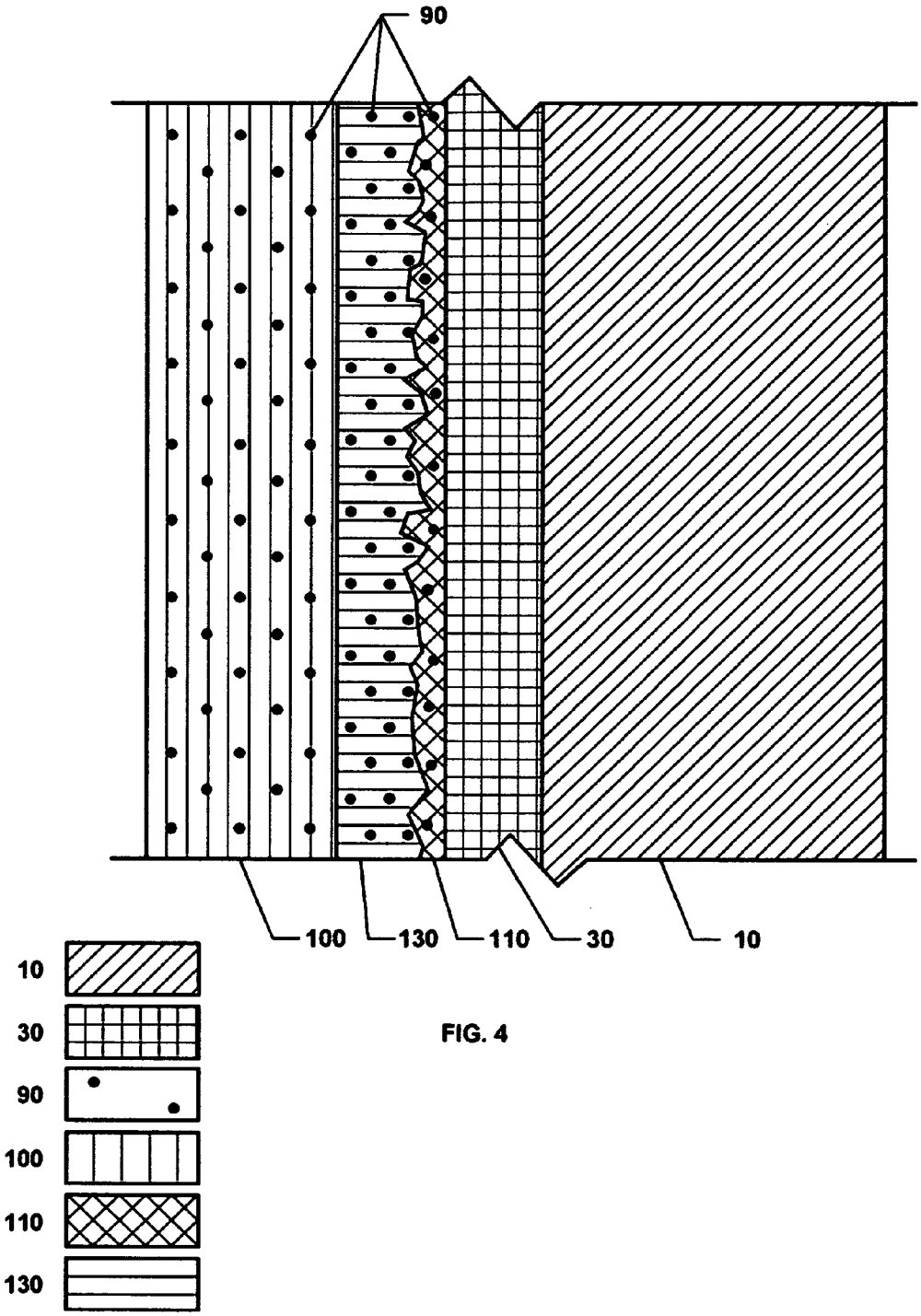
FIG. 4 is a sectional schematic diagram showing the low concentration of the product in the wash water following the actual wash cycle, after all of the wash water has been introduced.

FIG. 4 is a schematic diagram showing the low concentration of the composition 90 in the wash water 100 following the actual wash cycle after all of the' wash water has been introduced. The steady state condition of the application method is shown. The new layer of residue #130 with a moderate amount of the composition 90 entrained in the matrix will provide a surface that is toxic to the organisms that are able to consume the other material in the matrix. This will suppress the growth between washdays and significantly impact the odor issue. The old biofilm #110 that is under the new residue deposit #130 will continue to degrade due to the presence of the composition. The mass of the composition 90 in the wash water #100 will continue to be diluted and eventually will be flushed out of the machine.

The mass of composition 90 that is in the residue #130 apparently remains there for many wash loads that are not treated with the composition. This is probably due to the relatively low concentration gradient between the residue #130 and the wash water 100 of an untreated load. Once again plumbing surface #10 and original residue layer #30 remain unchanged.

Materials Summary

Borax in its various hydrated forms can be combined with other low toxicity materials in different compositions to combat microorganisms deposited on residues in the laundry machines. For example, boric acid can be included, alone or in combination with borax. Boric acid comes in various molecular forms, all of which are effective in the present compositions, and is commercially available as technical grade boric acid.

Bioactive salts can include alkali metal salts of carboxylic acids such as benzoic, sorbic or citric, and are generally selected from those materials which are toxic to microorganisms but generally recognized as safe by the FDA.

Weak organic acids having from one to about three carboxyl groups are used to create an acidic solution adjacent the residue and plumbing surfaces when the composition initially dissolves. By "weak" acids, it is meant that those which have dissociation constants producing pKa values in the range of about 2 to 22 in water. While citric acid has been employed effectively, other acids such as acetic can be used.

Inorganic peroxide sources such as alkali metal or alkaline earth metal percarbonates, perborates, metallic peroxides; carbamide peroxide, calcium and magnesium peroxides, potassium monopersulfate and sodium perborate monohydrate can be used.

Production Methods:

The present compositions are prepared in granular and/or powder form, with the particle size ranges and distributions effective to allow the compositions to dissolve readily in water, and particularly before the laundry soaps or detergents in a wash cycle go into solution. On the other hand, the particle sizes of ingredients, particularly peroxide sources, should not be so fine as to allow caking, swelling or other adverse effects during shipment or storage.

A variable speed, variable blade angle rotational mixer was used to prepare the mixtures. This was considered a low variability process so parameters were not specifically controlled.

This error was manifested in two batches that were mixed to the point that all the materials were reduced to a fine powder. At first this was seen as a positive effect to increase the rate of dissolution and was the intended result of the long mix cycle. However, after the material was packaged and sent to customers it was found that the finely powdered composition packed tightly together and hardened into a solid mass. Customer satisfaction dropped. Analysis resulted in the rotational mixer being connected to a timer and speed controller for improved process control.

Also, customer feedback indicated that the composition can lose effectiveness when stored for extended periods. Since all of the materials are stable as long as they remain dry, humidity is the most likely parameter causing degradation of performance. The component most sensitive to humidity degradation would be the sodium percarbonate or other peroxide source. It was decided to try to block or adsorb the humidity before it contacts the sodium percarbonate.

Therefore, a specified two step mixing procedure was developed. The procedure involves coating the percarbonate crystals with a thin coating of borax powder first. The second step involves the gentle entraining of the coated percarbonate crystals into the bulk of the other materials that remain as large crystals. The interstitial spaces are filled with borax powder to block the diffusion of humidity through the bulk of the composition. This procedure is intended to assure proper long term effectiveness. This is very important since some customers purchase the product only once a year and the composition needs to remain active until it is consumed.

General Mixing Procedures:

1. The first mixing step uses approximately one quarter of the borax and all of the perborate/percarbonate/peroxide in the composition formula. This first step is to coat the perborate/percarbonate/peroxide crystals or other peroxide source with the borax powder that will act as a desiccant to preserve the peroxide generating characteristics.

The first mixing step is few minutes in duration at a relatively high rotation rate (i.e., about 100 to 150 RPM) and a relatively high angle of mixing blade attack (i.e., about 60 to 90 degrees) to powder the borax so that it coats the percarbonate evenly. Because borax is a friable material, it will generate a fine powder. The harder crystals of perborate/percarbonate/peroxide will remain as crystals.

2. The second mixing step incorporates the rest of the materials, including the rest of the borax crystals. This mixing is brief. It is long enough to mix the ingredients thoroughly, but not so much that it fractures the large crystals of these ingredients. Some of the FDA preservative materials are very friable. They are much more friable than the borax so they need to be mixed at relatively slow rotation speeds (about 40 to 60 RPM) and moderate angles of mixing blade attack (about 40 to 70 degrees). Preservation of the large crystals is required for easy flow of the composition when dispensing. Visual appeal of the various shapes is also desired.

Proof of Efficacy:

The present compositions and methods must work across an extremely wide spectrum of variables. The variables include: machine make, machine model, detergent brand(s) used, softener brand(s) used, the ranges of amounts of each used in each load, ranges of water temperatures, ranges of the level of dirt and contaminants on the laundry, and the type and quality of water supply. The product must not impact a septic system if present. The product must work over a range of weekly laundry cleaning duty cycles. The product must be non-allergenic. Considering the range of variables times the number of kinds of organisms available across the country, it becomes obvious that all combinations can not be tested. However, information is available to support the efficacy of the various embodiments tested.

The theoretical efficacy of the concept of creating a passivated surface to suppress growth is demonstrated by recent published U. S. patent application of Samsung and Amana's U.S. Pat. No. 5,180,585, discussed above, wherein toxic materials are embedded into the surfaces of certain plumbing components to reduce the growth of biofilms which cause washing machine odor issues. These publications effectively provide proof of concept for the present invention. These two toxic surface systems apparently operate in a manner similar to the compositions disclosed herein, which create a toxic surface on the residue of any detergent and in any make or model of washing machine. The present compositions and methods create a temporary, dynamic surface layer that provides the same kind of continuous control at the residue surface.

The actual efficacy of the present compositions and methods is further demonstrated by the fact that tens of thousands of pounds of the present materials have been sold to thousands of customers since March, 2008 with no failures reported. The product comes with a money-back guarantee, and no claims have been submitted as of the date of the provisional application.

Previous uses of the continuous control method are apparently only minimally effective and are limited to specific parts of specific models of specific brands of washing machines. The present compositions and methods can be used in any washing machine. The amounts used can be adjusted to meet the needs of the problem. The dose cannot be adjusted in the referenced washing machines, resulting in poor performance in some situations. Amana uses their MICROBAN® product in the gasket only, while Samsung uses its colloidal silver material (SILVER NANO HEALTH SYSTEM™) in the drum only. In both cases, the amount of the biotoxic material is fixed during manufacture, and diminishes thereafter.

The proven success of Applicant's products across the entire country is due to the capacity to accommodate the needs of the consumer. These needs involve the flexibility to match the amount of the present compositions used to the amount of HE cleaners, including various soaps and detergents, the consumer chooses to use. An extremely broad field of problems can be addressed by the use of the present compositions. Overuse of detergents is very common. This overuse is acknowledged and the present invention addresses the situation that actually exists in the field.

The invention is further illustrated by the following non-limiting examples.

EXAMPLES

Discussion of Experimental Design

The residue is a matrix of soap, detergent, cotton or wool fibers, and any other organic matter that was introduced by the dirty laundry. This provides a wide array of substances that can support biological growth. The exact mixture is an uncontrolled variable but it considered to be bounded by the use of one machine in one location. Experimental control also involves a standardized volume of the laundry load and the exclusive use of cotton items in the laundry washed. The detergent portion of the matrix was standardized by using only TIDE® Liquid HE Detergent.

A standardized test procedure was developed for a High Efficiency (HE) laundry washing machine. The laundry machine was a TROMM Model # WM2688WM made by LG Electronics Inc. This make and model is representative of the population of laundry washers currently in use that are susceptible to the odor issue.

The test procedure involved a two week period between loads of laundry for the biofilm to develop on the residue. This is considered to be a nominal worst case condition in that the average customer will usually wash laundry at least once in any given 14 day period. Longer idle periods did not generate more odor.

The test procedure also involved a second growth period after the wash cycle where the damp laundry is allowed to sit idle in the laundry washing machine with the door closed. This idle period was intended to magnify the effect of a very small amount of growth that may have not have been sanitized in the previous wash. It also simulates the real world situation where the laundry my be left in the washing machine overnight. Given the above assumptions, it was reasonable to assume that the performance of the composition would be effectively quantified Personal experience with odor problem:

A TROMM Model # WM2688WM laundry washer made by LG Electronics Inc. was purchased. After a few months the odor problem was discovered. The currently available materials that are usually recommended by the manufacturers (vinegar, baking soda or chlorine bleach) and the commercially available products did not work well in this situation. Applicant started to investigate why a new, expensive washer had this kind of problem. He found that there seems to be an increase in odor when a lot of detergent and/or fabric softener is used. These are organic based materials. They provide a growth medium for mold, mildew and other biological growth. The odor is generated by this biofilm. The biofilm returns between each of the treatments.

Analysis Determined:

1. There will always be organic materials to provide a growth medium

2. There will always be mold and fungus spores in the air that will vary depending on the local environment that will find and populate the growth medium.

3. There will always be bacteria that are carried into the machine on the laundry and through other paths.

Therefore: The biological growth can not be kept out of the machine. Another approach is required to be successful.

The odor situation was analyzed and it was determined that the current products and methods had failed because they did not completely remove the residue that the provided the medium for the organic growth that cause the odors. It was decided to try to control biological growth in the machines Instead of the highly toxic materials that are used in industrial settings, more consumer safety oriented materials were investigated. Analysis further indicated that even though the HE detergent material has a high viscosity it will nonetheless easily coat the surface of the plumbing along with the laundry. During the wash the high viscosity detergent coats the laundry material fibers and then it is slowly rinsed out as the bulk of the wash water is introduced. However, the high viscosity detergent also coats the plumbing and does not rinse away as it well as it does from the laundry because the machine is designed to rinse the detergent from the fibers by means of a flow through process that does not involve rinsing the interior surface of the plumbing. Therefore, the residue accumulates over time.

The detergent residue is combined with fibers from cotton, wool and other organic materials from the dirty laundry. This matrix then forms a nutrient surface to be consumed by all manner of mold, mildew and other fungi, and bacteria. All current products and methods attempt to remove the residue matrix thereby removing the growth. The success rate is very low in many situations.

Since the primary odor was thought to come from mildew, a well known material, 20 MULE TEAM BORAX® detergent was used as a detergent. The boron contained in the detergent is a toxic material that controls mold and fungus. Use of the 20 Mule Team Detergent reduced the odor but did not eliminate it. It also caused the laundry washer to shut down due to a safety error triggered by excessive sudsing in the drum. The commercially available detergent contained a small amount of boron along with various other chemicals necessary for laundry cleaning. A higher concentration of boron with no extraneous materials was thought to be more effective.

Pure, technical grade borax (10 MOL) was subsequently identified and obtained as an appropriate material to start with. Since the residue had the property of tenaciously adhering to the surface, another idea involved poisoning future layers of residue as the layer is deposited with the intent of creating a passivated surface so that growth would be suppressed.

Instead of attempting to remove the residue, it might be possible to introduce toxic materials in situ as the residue is deposited.

The invention is further illustrated by the following non-limiting examples

Example 1

100% Borax—Sodium Borate Decahydrate

One ounce of the borax was added to the machine for each load.

The laundry volume was standardized at a full basket of 2.5 Cu Ft.

All wash cycles were run with warm water.

The resultant odor control exceeded the control obtained from any other methods attempted. However, it was very erratic. Experimentation with various laundry cycles revealed that the borax worked much better if it dissolved first. This resulted in the deposition matrix model being developed. Identification of the "dissolve first" application method resulted in the determination that it was required for effective odor control.

Experimental Design

At this point the overall odor problem was determined to probably be the presence of residue covered surfaces which were themselves covered with biofilm. The biofilm that generates the odor is disinfected by contact with the composition. The toxic material, boron, apparently suppresses future growth by using a specific application method to achieve a sufficient concentration in the residue to be effective. The borax worked well as long as it was used in every load and there were more than four loads a week. If this was not done, then the effectiveness was unsatisfactorily intermittent.

Experimentation with idle periods ranging from twenty four hours to three weeks verified that the intensity of the odor problem was a function of the biofilm growth in the machine during the idle period of the washing schedule. The first load of the week was the most odoriferous. Subsequent loads had fewer odors. Therefore, it was determined that the criteria for effectiveness would be focused on the first load of the week. The experimental design embraces the fact that many of the parameters have an inherent variability that can not be controlled well. However, these parameters are considered to be bounded by limits inherent in the material or equipment used. Gage studies were not performed.

This lack of precise experimental control was offset by the fact that the desired result of the experiments is a binary choice of no-odor/odor as Pass/Fail criteria. As explained below, the procedure was designed to magnify the odor signal so a determination of no-odor was a valid conclusion and considered a Pass.

The residue was a matrix of soap, detergent, cotton or wool fibers, and any other organic matter that was introduced by the dirty laundry. This provided a wide array of substances that can support biological growth. Therefore, a wide array of organisms could be present and the exact biofilm mixture was considered an uncontrolled variable. However, in these Examples the mixture was considered to be bounded by the use of one machine in one location. Experimental control also involved a standardized volume of the laundry load of 2.5 cu. ft. and all the items of laundry washed were cotton. A laundry basket was filled to the top without intentionally packing the items. The detergent portion of the matrix was standardized by using only one tablespoonful of TIDE® Liquid HE Detergent per load. Liquid softeners were not used, to avoid confounding results.

Given the standardization explained above, a test procedure was developed for identifying the presence of objectionable odors in a High Efficiency (HE) laundry washing machine. The laundry machine was a TROMM Model # WM2688WM made by LG Electronics Inc. This make and model was representative of the population of laundry washers currently in use that were susceptible to the odor issue.

The wash time and amount of water used are a function of the weight of the laundry. The machine spins the dry laundry twice to quantify the weight of the laundry in the drum. The machine controller then meters in the correct amount of water to wash the laundry. This parameter can vary due to density of the laundry packed in the basket. The parameter's variability was considered to bounded by the small range available. No corrections were made for this small error potential.

Test Procedures:

1. Allow laundry machine to sit idle for 14 days.
2. Fill the laundry machine with a full basket of cotton laundry (2.5 cu ft).
3. Add one tablespoon full of Tide HE detergent to the detergent dispensing tray.
4. Add one ounce of the composition to the dispensing tray such that it covers the detergent.
5. Close dispensing drawer and laundry machine door.
6. Select "Cotton/Normal" to obtain default conditions of the machine.
   a. Warm water wash
   b. Cold water rinse
   c. High spin speed
   d. Normal soil level
7. Press start.
8. Machine will perform the pre-programmed steps for the cycle selected.
9. At the end of the rinse cycle, do not remove laundry from drum
10. At the end of the rinse cycle, do not open machine door.

11. Let system sit idle for a minimum of 12 hours. (Variability regarding the extra time is negligible, as determined by early experiments.)

12. After idle time, open machine door.

13. Perform standard "whiff test" by waving hand past door opening towards nose.

14. Determine if there is an odor.

15. If there is an odor then the experiment is considered a Fail.

16. Remove laundry from drum, place items near nose and inhale.

17. Determine if there is an odor.

18. If there is an odor, then the experiment is considered a Fail.

Any odor identified at this point results in a Fail for the experiment and the assumption that the composition was not as effective as it needs to be.

Secondary Testing:

19. Place laundry in dryer.

20. Set to "extra dry."

21. Press Start.

22. At the end of the cycle, open door and perform whiff test.

23. Determine if there is an odor.

24. If there is an odor, then the experiment is considered a Delayed Fail.

25. Segregate enough of this laundry to satisfy the needs of three days.

26. As these laundry items are used, determine if there is an odor.

27. If there is an odor, then the experiment is considered a Delayed Fail.

Any odor identified at this point results in a Delayed Fail for the experiment and the assumption that the composition was not as effective as it needs to be will be investigated. Also, there was verification that the procedural steps were followed.

A run that results in a Fail will stop production.

A run that results in a Delayed Fail will not stop production. It will trigger an investigation because the performance was atypical. Given the above, it was reasonable to assume that the performance of the composition would be effectively quantified.

The materials were weighed on a Salter electronic balance with a stated accuracy of +/−1 gm. Given the accuracy of the entire process that was being performed, it was decided that a gage study of the balance would not be necessary. The factory calibration and specifications were accepted as published. The formulation of the various compositions was performed by manual mixing of the components involved. A mixing paddle was utilized at a slow rate which resulted in the crystals retaining their sizes and shapes.

Example 2 involved an increase in amount of boron available by creating a composition to make it more toxic. This was done by adding boric acid to the 10 mol borax. The effect was not significant on first load performance, but there seemed to be an effect on subsequent loads so the trend was correct.

Example 2

90% Borax—Sodium Borate Decahydrate
10% Boric Acid

The addition of the extra boron to the composition did not affect first load performance.

Example 3

80% Borax—Sodium Borate Decahydrate
20% Boric Acid

First Load results were slightly better but not satisfactory or consistent.

Mixing the samples for testing was not a problem, but consistently mixing large batches in future production batch sizes was seen to be problematic. So, instead of increasing the concentration of boron in steps it was decided to go to 5 mol concentration borax as a step function to boost the odor control. (MOL in the case of borax refers to water of hydration content) This twofold increase in boron concentration did increase the control of first load odors, but it was still erratic.

Increasing the boron content further would no doubt increase the odor control even more. However, environmental concerns regarding the persistence of boron negated that approach. The product must have a minor effect on septic tanks and too much boron could result in its persistent presence affecting the performance of the septic digester. Since the twofold increase in boron from the 10 mol to 5 mol did not have an effect large enough to justify the increase in environmental impact due to the increase in the boron mass, it was decided to return to the 10 mol borax of Example 1 and add other chemical(s) to it. Analysis of the situation resulted in the problem being divided into two issues. The water in the machine has odoriferous growth floating in it at the start of the cycle. Biofilm growth on the residue will slough-off of the surface and be mixed in the water.

Each Issue was Attacked Individually:

First, the growth floating in the water was attacked by an aggressive disinfection agent because of the short time period for this part of the wash cycles.

Second, the growth infecting the surface of the residue was suppressed further by adding other biotoxic chemicals to be entrained in the residue.

For an aggressive disinfecting agent, sodium percarbonate was chosen because it evolves hydrogen peroxide when dissolved in water. This results in the disinfecting of the existing water. This is a broad spectrum method of rapidly disinfecting the water in the machine that remained after the last wash cycle. The choice of a hydrogen peroxide generating material as an active ingredient results in a minimized mass of toxic materials discharged at the end of the wash cycle.

Example 4

95% Borax—sodium borate decahydrate
5% Sodium Percarbonate.

Adding sodium percarbonate to the composition made a significant difference in first load odor control. However, there were a number of random failures that could not be allowed if the product was to be successful.

Additional chemicals were investigated to be added to the composition to more effectively suppress the biofilm growth during the idle periods. The intent was to minimize the amount of biological material available in the water at the start of the next wash cycle.

A number of toxic materials were considered for addition. The persistent nature of these was problematic.

Another approach was to investigate chemicals that are used in preserving food or disinfecting surfaces. These items are non-toxic to humans at low concentrations, so they will not present a hazard in use or shipping. A number of compounds were investigated. It was decided that all materials must be solids and must easily dissolve in water. Two chemicals were selected from a non-limiting list of preservatives that had familiar names so as not to be off-putting to the public:

sodium benzoate and potassium sorbate. These are broad spectrum preservatives and could have an effect on biofilm growth.

Example 5

94% Borax—Sodium Borate Decahydrate (10 mol)
5% Sodium Percarbonate
1% Sodium Benzoate Example 6

94% Borax—Sodium Borate Decahydrate (10 mol)
5% Sodium Percarbonate
1% Potassium Sorbate Both compositions resulted in significant increase in first load performance.

Synergistic effects were not investigated due to the decision to jump directly to a best estimate composition of the various compounds tested to this point. Literature references indicate that the preservative performance of these chemicals can be enhanced by a low pH. Boric acid was ineffectual at changing the pH due to the buffering of the borax. Citric acid was chosen to be added to the mixture to lower the initial pH.

Example 7

92% Borax 10 mol,
5% Sodium Percarbonate,
1% Citric acid,
1% Boric acid,
0.5% Sodium Benzoate,
0.5% Potassium Sorbate, This mixture was extensively tested using the standardized procedure, and in all instances first load odors were eliminated.

Example 8

89% Borax 10 mol,
5% Sodium Percarbonate,
1% Citric acid,
1% Boric acid,
0.5% Sodium Benzoate,
0.5% Potassium Sorbate,
3% Magnesium Sulphate Since future performance will be monitored by customer satisfaction it may be necessary to modify the composition within the parameters of this application. A method of identifying batches was investigated. It was decided to add an amount of magnesium sulphate as above. Magnesium sulphate is also known as Epsom salts. Such salts can produce an additional sanitizing effect due to osmotic dehydration of the biofilm. Epsom salts can be purchased in different colors and therefore can be used as a batch identifier. The colored Epson salts and the crystal shapes and sizes present an image of quality for customer satisfaction. Epsom salts can also be a fragrance source that can be varied for customer satisfaction purposes. It was found that the addition of magnesium sulphate did not affect the odor control in the limited number of trials.

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications, and are the sole limits on the scope of the invention.

What is claimed is:

1. A deodorizing composition of mixtures of granular and powder forms of dry ingredients comprising amounts of at least one boron compound, a bioactive salt and a weak organic acid, plus an alkali metal salt of said acid, effective to sanitize and remove odors from biofilms in laundry washing machines, wherein said bioactive salt and said weak organic acid are generally recognized as safe by the FDA and wherein said ingredients are present in the following approximate proportions in weight percent:
boron compound(s)—90 to 95,
bioactive salt—0.5 to 2, and
weak organic acid—2 to 5.

2. The composition of claim 1 wherein said at least one boron compound is selected from the group consisting of boraxes, boric acids and alkali metal perborates.

3. The composition of claim 1 wherein said weak organic acid is a carboxylic acid having from one to about three carboxyl groups and a dissociation constant producing a pKa value between about 2 and about 22.

4. The composition of claim 1 wherein said bioactive salt is an alkali metal salt of an organic acid.

5. The composition of claim 3 wherein said organic acid is selected from the group consisting of sorbic acid, benzoic acid, citric acid and propanoic acid.

6. A deodorizing composition of mixtures of granular and powder forms of dry ingredients comprising amounts of at least one boron compound, a bioactive salt and a weak organic acid, plus an alkali metal salt of said acid, effective to sanitize and remove odors from biofilms in laundry washing machines, wherein said bioactive salt and said weak organic acid are generally recognized as safe by the FDA and further comprising an inorganic peroxide source selected from the group consisting of alkali metal or alkaline earth metal percarbonates, perborates and persulfates, and carbamide peroxide, wherein said ingredients are present in the following approximate proportions in weight percent:
boron compound(s)—90 to 95,
bioactive salt—0.5 to 2,
weak organic acid—1 to 3, and
inorganic peroxide source—3 to 5.

7. The composition of claim 1, further comprising Epsom salts.

8. A method of employing the composition of claim 1 to treat a laundry washing machine by introducing an effective amount of said composition into the machine in a manner which enables the composition to dissolve substantially completely before the laundry cleaning materials dissolve in a normal wash cycle.

9. A method of employing the composition of claim 6 to treat a laundry washing machine by introducing an effective amount of said composition into the machine in a manner which enables the composition to dissolve substantially completely before the laundry cleaning materials dissolve in a normal wash cycle.

10. A sanitizing and deodorizing composition of mixtures of granular and powder forms of dry ingredients comprising from about 90 to 95 weight percent of a borax, from about 3 to about 5 weight percent of an alkali metal percarbonate, from about 0.5 to about 2 weight percent of citric acid as a weak organic acid, from about 0.5 to about 2 weight percent of boric acid, from about 0.2 to about 1 weight percent of sodium benzoate and/or potassium sorbate as a bioactive salt and from 0 to about 5 weight percent of magnesium sulphate, said ingredients being present in proportions effective to sanitize and remove odors from biofilms in laundry washing machines, wherein said bioactive salt and said weak organic acid are generally recognized as safe by the FDA.

11. A method of mixing the materials of claim 10 to obtain a product, comprising steps of:

a) mixing about one fourth of said borax with all of said percarbonate in a manner effective to coat the crystals of said percarbonate with said borax, and b) adding the remaining ingredients, including all borax, and admixing the combined ingredients in a manner to thoroughly mix all ingredients without fracturing the larger crystals of the added ingredients.

12. The method of claim 11 which produces a deodorizing composition which dissolves readily in aqueous liquids and can be stored for a reasonable length of time without caking or swelling.

13. The composition of claim 1 which is formulated to dissolve readily in aqueous liquids and can be stored for a reasonable length of time without caking or swelling.

14. The composition of claim 10 which is formulated to dissolve readily in aqueous liquids and can be stored for a reasonable length of time without caking or swelling.

15. The composition of claim 10 wherein the particles of said alkali metal percarbonate are coated with a portion of said borax.

16. The composition of claim 2 which comprises at least one borax and at least one boric acid.

17. The composition of claim 14 which produces an acidic solution when dissolved in aqueous liquids.

18. The composition of claim 10 wherein said granular and powder forms of said dry ingredients are effective to produce a mixture which dissolves readily in aqueous solutions and can be stored without caking or swelling.

* * * * *